US007997261B2

(12) United States Patent
Scaniffe

(10) Patent No.: US 7,997,261 B2
(45) Date of Patent: Aug. 16, 2011

(54) COMPOUND BOW ACCESSORY

(76) Inventor: Michael J. Scaniffe, Killingworth, CT (US)

( * ) Notice: Subject to any disclaimer, the term of this patent is extended or adjusted under 35 U.S.C. 154(b) by 385 days.

(21) Appl. No.: 12/314,016

(22) Filed: Dec. 2, 2008

(65) Prior Publication Data

US 2010/0018513 A1 Jan. 28, 2010

Related U.S. Application Data

(60) Provisional application No. 61/135,529, filed on Jul. 22, 2008, provisional application No. 61/189,716, filed on Aug. 22, 2008.

(51) Int. Cl.
*F41B 5/14* (2006.01)

(52) U.S. Cl. ..... 124/87; 124/86; 124/88; 33/265

(58) Field of Classification Search ..... 124/87, 124/88, 86; 33/265
See application file for complete search history.

(56) References Cited

U.S. PATENT DOCUMENTS

| | | | | |
|---|---|---|---|---|
| 3,641,675 | A * | 2/1972 | Funk, Jr. | 33/265 |
| 4,961,264 | A | 10/1990 | Topel | |
| 5,175,937 | A | 1/1993 | Emerson, III | |
| 5,255,440 | A * | 10/1993 | Rogers | 33/265 |
| 5,289,814 | A * | 3/1994 | Maisano | 124/87 |
| 5,367,780 | A * | 11/1994 | Savage | 33/265 |
| 5,400,764 | A * | 3/1995 | Spolar et al. | 124/88 |
| 5,442,861 | A * | 8/1995 | Lorocco | 42/132 |
| 5,464,003 | A * | 11/1995 | Sherman | 124/87 |
| 5,662,093 | A * | 9/1997 | DenHerder | 124/23.1 |
| 5,671,724 | A | 9/1997 | Priebe | |
| 6,000,141 | A * | 12/1999 | Afshari | 33/265 |
| 6,073,352 | A * | 6/2000 | Zykan et al. | 33/265 |
| 6,418,633 | B1 * | 7/2002 | Rager | 33/265 |
| 6,477,778 | B1 * | 11/2002 | Lorocco | 33/265 |
| 6,508,005 | B2 * | 1/2003 | Springer | 33/265 |
| 6,560,884 | B1 * | 5/2003 | Afshari | 33/265 |
| 6,564,462 | B1 * | 5/2003 | Henry | 33/265 |
| 6,601,308 | B2 * | 8/2003 | Khoshnood | 33/265 |
| 6,609,306 | B2 * | 8/2003 | Johnson et al. | 33/265 |
| 6,701,632 | B2 * | 3/2004 | Henry | 33/265 |
| 6,802,129 | B1 * | 10/2004 | Wirth | 33/265 |

(Continued)

FOREIGN PATENT DOCUMENTS

EP 0568218 11/1993

(Continued)

OTHER PUBLICATIONS

Toxonics' New Balance Stabilizer Adds Stability to Bows, © 2008, http://www.buckmasters.com/bm/Resources/NewProducts/Products/tabid/180/articleType/ArticleView/articleId/583/Default.aspx 1 page printed from the Internet on Jul. 23, 2008.

(Continued)

*Primary Examiner* — Gene Kim
*Assistant Examiner* — Alexander R Niconovich
(74) *Attorney, Agent, or Firm* — Richard C. Litman

(57) ABSTRACT

The compound bow accessory includes a bracket adapted for mounting to the bow riser of a compound bow, an adjustable bar connected to the bracket and an alignment assembly adjustably mounted to the bar. The alignment assembly includes a pair of vertical alignment pins permitting the user to visually align with the sight pins of a bow sight between the upright pins. The compound bow accessory provides another point of reference in the process of aiming such that the user may reduce inaccuracies due to hand torque.

19 Claims, 10 Drawing Sheets

U.S. PATENT DOCUMENTS

| | | | | |
|---|---|---|---|---|
| 6,823,597 | B2 * | 11/2004 | Larson | 33/265 |
| 6,851,197 | B2 * | 2/2005 | Terry et al. | 33/265 |
| 6,892,462 | B2 * | 5/2005 | Rager | 33/265 |
| 6,925,721 | B2 * | 8/2005 | Dietz | 33/265 |
| 6,938,349 | B2 * | 9/2005 | Afshari | 33/265 |
| 7,000,327 | B2 * | 2/2006 | Rager | 33/265 |
| 7,036,234 | B2 * | 5/2006 | Rager | 33/265 |
| 7,100,291 | B2 * | 9/2006 | Afshari | 33/265 |
| 7,100,292 | B2 * | 9/2006 | Afshari | 33/265 |
| 7,103,981 | B1 * | 9/2006 | Rager | 33/265 |
| 7,159,325 | B2 * | 1/2007 | Rager | 33/265 |
| 7,200,944 | B2 * | 4/2007 | Rager | 33/265 |
| 7,275,327 | B2 * | 10/2007 | Deien | 33/265 |
| 7,275,329 | B2 * | 10/2007 | Rager | 33/265 |
| 7,308,891 | B2 * | 12/2007 | Graf | 124/87 |
| 7,343,686 | B2 * | 3/2008 | Rager | 33/265 |
| 7,412,771 | B2 * | 8/2008 | Bradley et al. | 33/265 |
| 7,461,460 | B2 * | 12/2008 | Priebe | 33/265 |
| 7,464,477 | B2 * | 12/2008 | Afshari | 33/265 |
| 7,503,122 | B2 * | 3/2009 | Afshari | 33/265 |
| 7,503,321 | B2 * | 3/2009 | Afshari | 124/87 |
| 7,549,230 | B2 * | 6/2009 | Rager | 33/265 |
| 7,574,810 | B1 * | 8/2009 | LoRocco | 33/265 |
| 7,578,067 | B2 * | 8/2009 | Rager | 33/265 |
| 7,603,784 | B2 * | 10/2009 | Erhard | 33/265 |
| 2001/0032393 | A1 * | 10/2001 | Springer | 33/265 |
| 2004/0088872 | A1 * | 5/2004 | Deien | 33/265 |
| 2004/0111900 | A1 * | 6/2004 | Rager | 33/265 |
| 2005/0150119 | A1 * | 7/2005 | Ellig et al. | 33/265 |
| 2005/0183272 | A1 * | 8/2005 | Meadows | 33/265 |
| 2006/0201005 | A1 * | 9/2006 | Lueck | 33/265 |
| 2007/0227018 | A1 * | 10/2007 | Ellig | 33/265 |
| 2008/0005914 | A1 * | 1/2008 | Afshari | 33/265 |
| 2008/0168671 | A1 * | 7/2008 | Rager | 33/265 |
| 2008/0282560 | A1 * | 11/2008 | Bradley et al. | 33/265 |
| 2009/0114203 | A1 * | 5/2009 | Sterner et al. | 124/87 |

FOREIGN PATENT DOCUMENTS

| | | |
|---|---|---|
| JP | 2000180095 | 6/2000 |

OTHER PUBLICATIONS

Hind Sight Inc. website: http://www.hindsightco.com/, 3 pages printed from the Internet on Aug. 11, 2008.

* cited by examiner

COMPOUND BOW ACCESSORY

This application claims priority to U.S. provisional application Ser. No. 61/135,529, filed on Jul. 22, 2008, and U.S. provisional patent application Ser. No. 61/189,716, filed on Aug. 22, 2008.

BACKGROUND OF THE INVENTION

1. Field of the Invention

The present invention relates to archery accessories, and more specifically to a compound bow accessory configured to provide improved aiming accuracy by providing visual cues indicative of hand torque that must be corrected for accurate shots.

2. Description of the Related Art

Bows are one of the oldest ranged weapons known to mankind. They have progressed far in terms of sheer power and accuracy. Modern compound bows are some of the latest innovations for these types of weapons. The largest benefit of compound bows stem from how a compound bow manages draw force, i.e. the force required to pull the bowstring and store the potential energy that is transferred to kinetic energy to shoot an arrow.

A typical recurve bow or longbow requires a constantly increasing amount of force throughout the user defined draw length of the bow. Once drawn, that force must be maintained while aiming. Unlike traditional bows where the bow may be drawn to virtually any length, modern compound bows are designed to be shot from a full drawn position, i.e. a predetermined max draw length depending on the specific setup of the compound bow. The force required to draw the bow to the full draw length varies as the user pulls the string due to the levering system unique to compound bows, the levering system usually comprised of cables, pulleys and/or cams connected to bendable limbs that store the potential energy.

In a compound bow, the draw force peaks about midway of the full draw length, then that force tapers off drastically as the user reaches max draw. How aggressive and where that reduction of draw force occurs is determined by the setup of the pulleys and cam geometry. Thus, while max effort may be required to draw the compound bow a certain distance of full draw, a much-reduced amount of effort is required to maintain full draw. This aspect of compound bows provides the user with more time to aim since the user does not have to expend as much physical effort to keep full draws as normally occurs with traditional bows. However, that wider window of time for aiming leads to more instances of unintentional hand torque, a phenomenon in which the user inadvertently twists the grip hand resulting in a missed shot. Accessories such as a bow sight aid in improving the accuracy of a shot, but it does not aid in reducing or preventing hand torque.

Thus, a compound bow accessory solving the aforementioned problems is desired.

SUMMARY OF THE INVENTION

The compound bow accessory includes a bracket adapted for mounting to the bow riser of a compound bow, an adjustable bar connected to the bracket and an alignment assembly adjustably mounted to the bar, the alignment assembly having a pair of upright pins permitting the user to visually align with the sight pins of a bow sight between the upright pins. The compound bow accessory provides another point of reference in the process of aiming such that the user may considerably reduce the chances of inaccurate shots due to hand torque.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
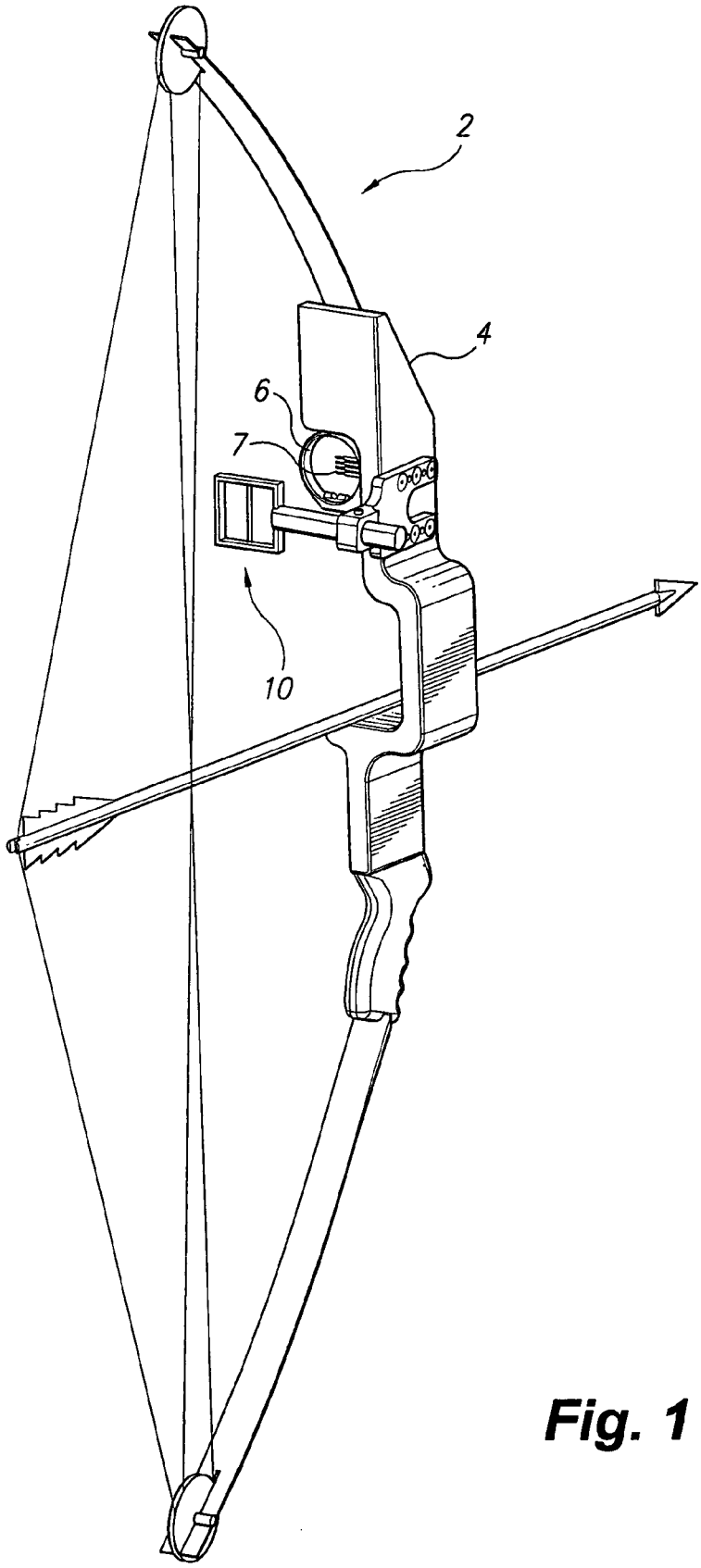
FIG. 1 is an environmental, perspective view of a compound bow accessory according to the present invention.

The present invention relates to a compound bow accessory 10 that improves accuracy of shots by providing visual cues indicative of existence of hand torque, which requires necessary compensation in aim. As shown in FIG. 1, the compound bow accessory is adjustably mounted to the bow riser of a compound bow 2. The compound bow accessory works in conjunction with a bow sight 6 and/or peep sight, and the synergy therebetween will be explained further below.

The compound bow accessory 10 includes a substantially U-shaped bracket 12 with a plurality of counter-sunk holes 13 adapted for mounting the same to mounting holes in a bow riser. The threaded holes 14 disposed therebetween are for mounting a conventional quiver. The proximal end of the bracket includes an extension having a substantially cylindrical through bore perpendicular to the plane of the bracket where an elongate bar 16 may be adjustably clamped by a screw 15. A split notch is formed on one end of the bar to adjustably hold an alignment assembly 20. The alignment assembly 20 includes a substantially square-shaped housing or frame 26 having a pair of vertical alignment pins 22 disposed centrally within the frame to thereby define a gap or viewing window 23 between the alignment pins 22. This gap or viewing window 23 functions as a visual aid in aligning or squaring the shot. Both the top and bottom legs of the frame 26 are provided with a pair of luminescent indicators 28 to help focus the user's view onto the alignment pins 22 and the gap 23 defined therebetween, especially in low light conditions. The indicators 28 are arranged to correspond to the top and bottom ends of the alignment pins 22. The luminescence of the indicators 28 may be provided by fiber optics, luminescent painted dots or LEDs (light emitting diode) connected to an appropriate power source.

Figure 2:
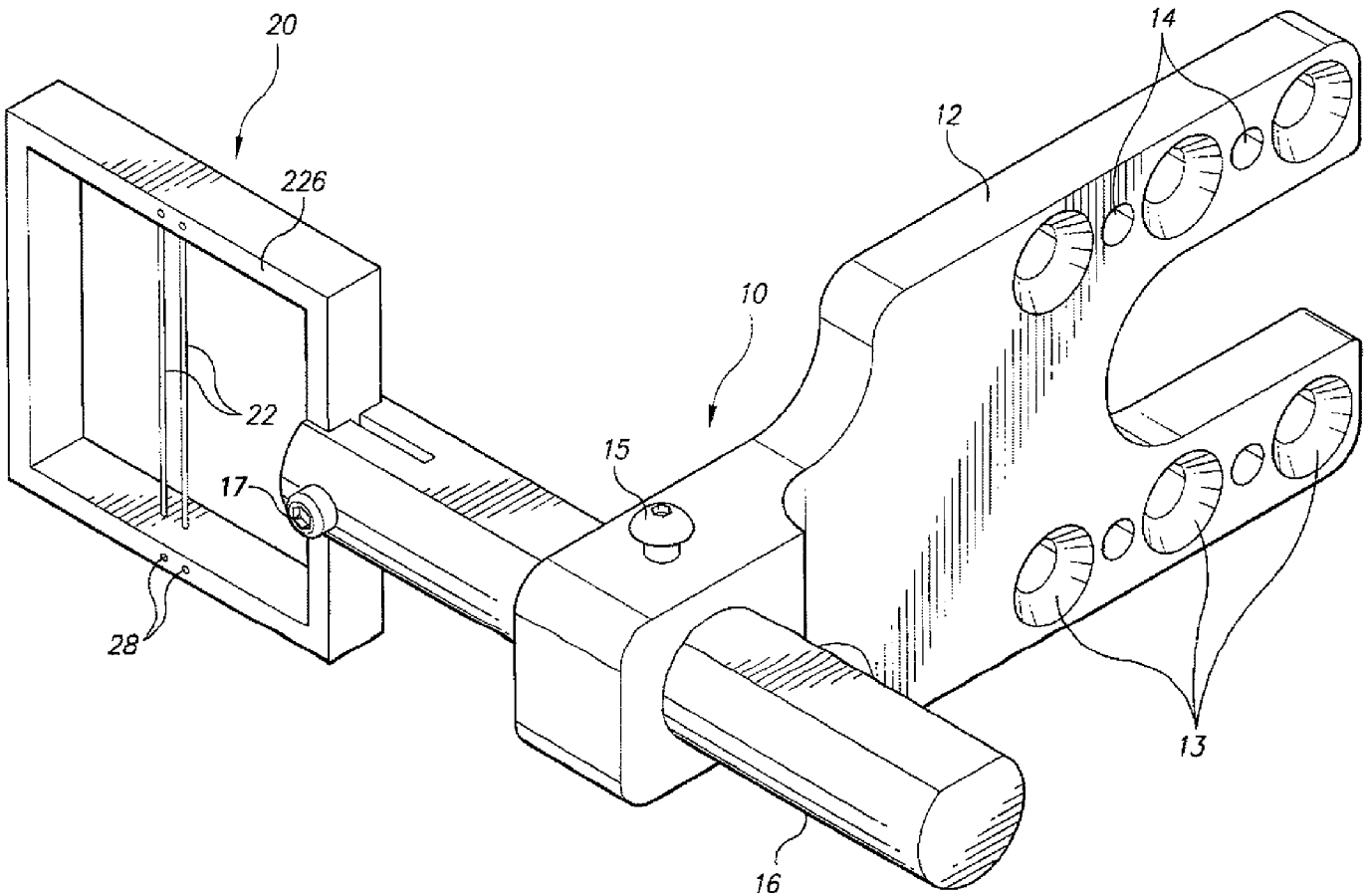
FIG. 2 is a perspective view of the compound bow accessory according to the present invention.
Figure 3:
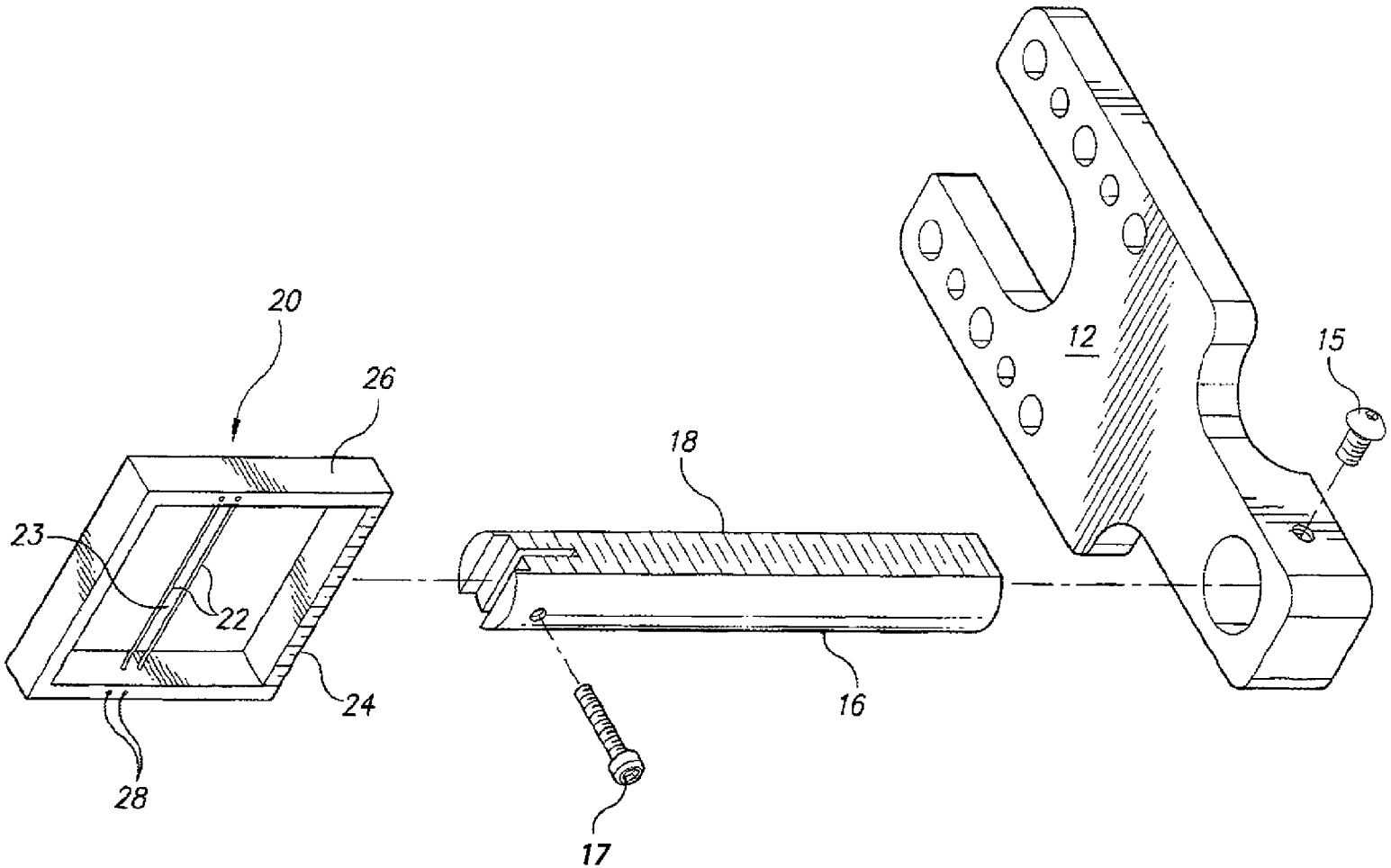
FIG. 3 is an exploded view of the compound bow accessory according to the present invention.
Figure 6:
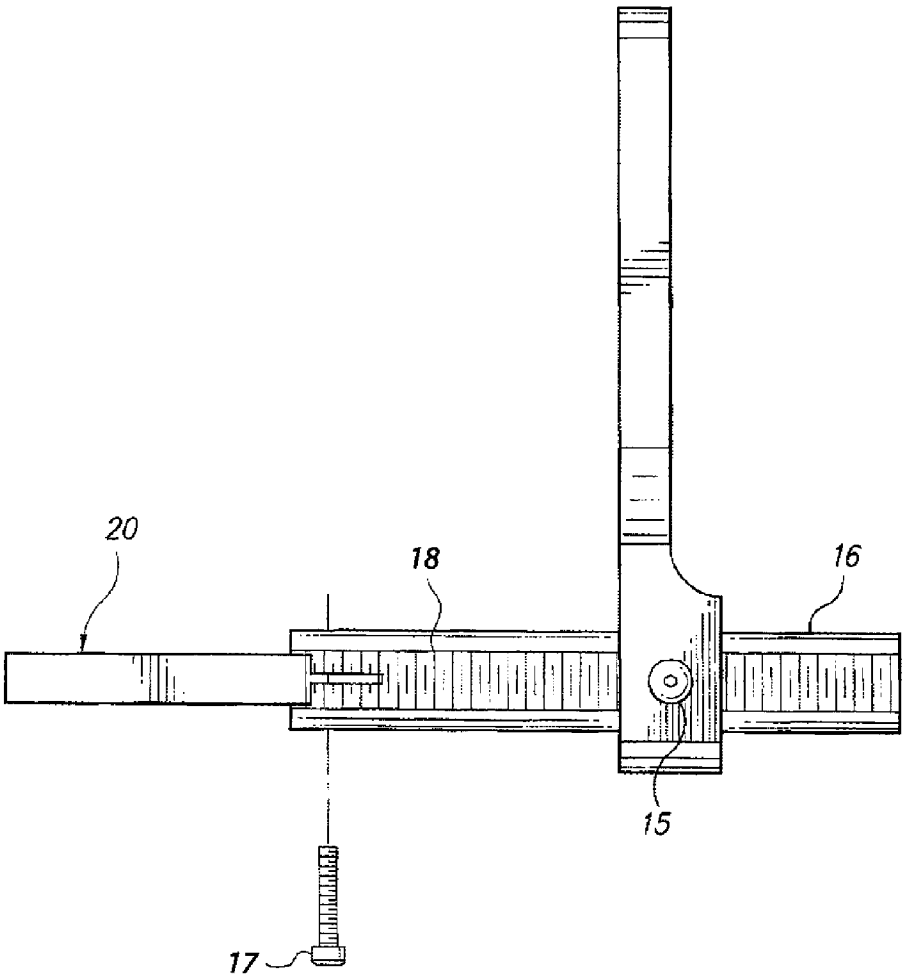
FIG. 6 is a top view of the compound bow accessory according to the present invention.

The compound bow accessory 10 is capable of a variety of configurations based upon the specifics of a user. For example, as seen in FIGS. 2, 3, and 6, the adjustable bar 16 has a planed flat portion with indicia 18 thereon which the user may use to accurately set the length of extension for the alignment assembly 20. One side of the frame 26, preferably the side facing the user, also includes indicia 24 on the leg portion of the frame that mounts to the adjustable bar 16 so that the user may vertically adjust the alignment assembly relative to the bar 16, and then be fixed in position by the fastener 17.

Figure 4:
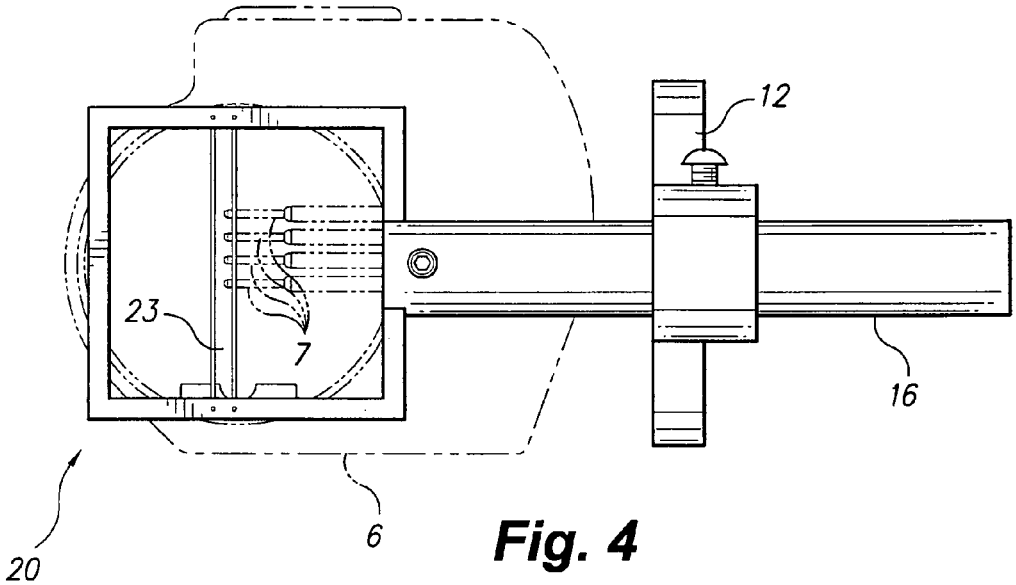
FIG. 4 is a front view of the compound bow accessory according to the present invention and its function with a bow sight.
Figure 5:
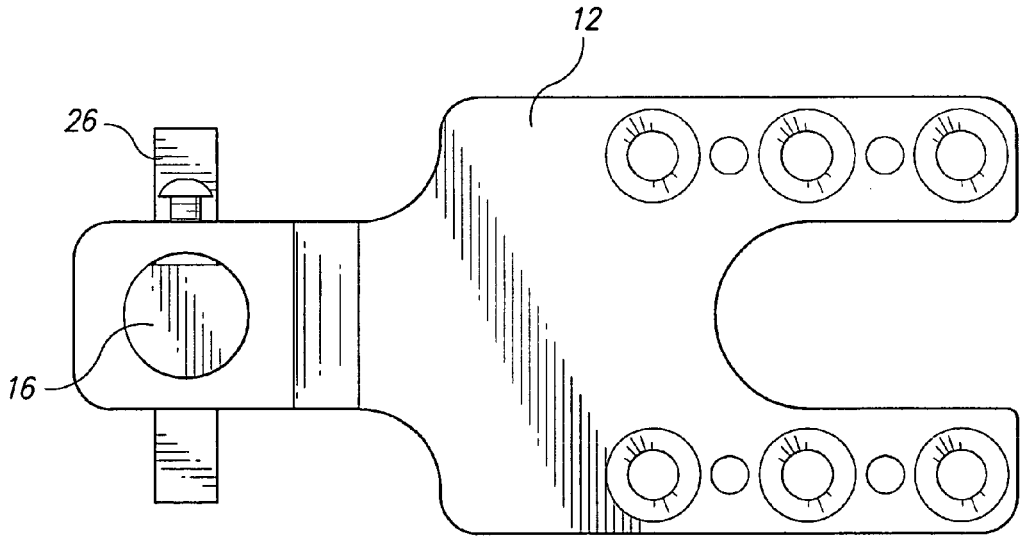
FIG. 5 is a side view of the compound bow accessory according to the present invention.

The following describes how the invention is used. As shown in FIGS. 1 and 4, the compound bow accessory 10 is adapted to be used in conjunction with a conventional bow sight 6 and/or peep sight (peep sight is not shown but it is typically attached to the bowstring). In the current example, the bow sight 6 includes a substantially circular housing with a plurality of front sight pins 7 arranged in a vertical plane. Each front sight pin 7 is a visual indicator of relative distance to target, i.e. the topmost sight pin indicates the shortest distance while the lowermost pin indicates the longest distance, these distances being preset by the experience of the user and the configuration of the bow.

As mentioned previously, the bow sight 6 assists in aiming the bow, but it has no means to prevent hand torque mainly due to the bow sight being only one point of reference to assess the accuracy of aim. With the inclusion of the compound bow accessory 10, inaccurate shots due to hand torque may be prevented because the compound bow accessory 10 provides a second point of reference to determine the accuracy of the shot.

The synergy between the compound bow accessory 10 and the bow sight 6 is more clearly shown in FIG. 4. When the arrow is drawn and the user takes aim, the user aligns, i.e. squares, the front sight pins 7 within the viewing window 23 of the alignment assembly. If the sight pins 7 are not aligned within the viewing window 23 while aiming, then this deviance is a clear indication of hand torque that must be corrected. Thus, the two points of reference, one from the bow sight 6 and the second from the compound bow accessory 10, insures that any deviance in true aim due to hand torque may be corrected prior to the shot being taken. It is noted that the effectiveness of the above is increased when used in conjunction with a peep sight (not shown), because that results in three points of reference for accurate aim. After the sight pins 7 are squared within the window 23 to the user's satisfaction, the user then takes the shot confident that any inaccuracies would not be attributed to hand torque.

The following discusses various possible embodiments of the invention. They all function similar to above in reducing or preventing inaccurate shots due to hand torque.

Figure 7:
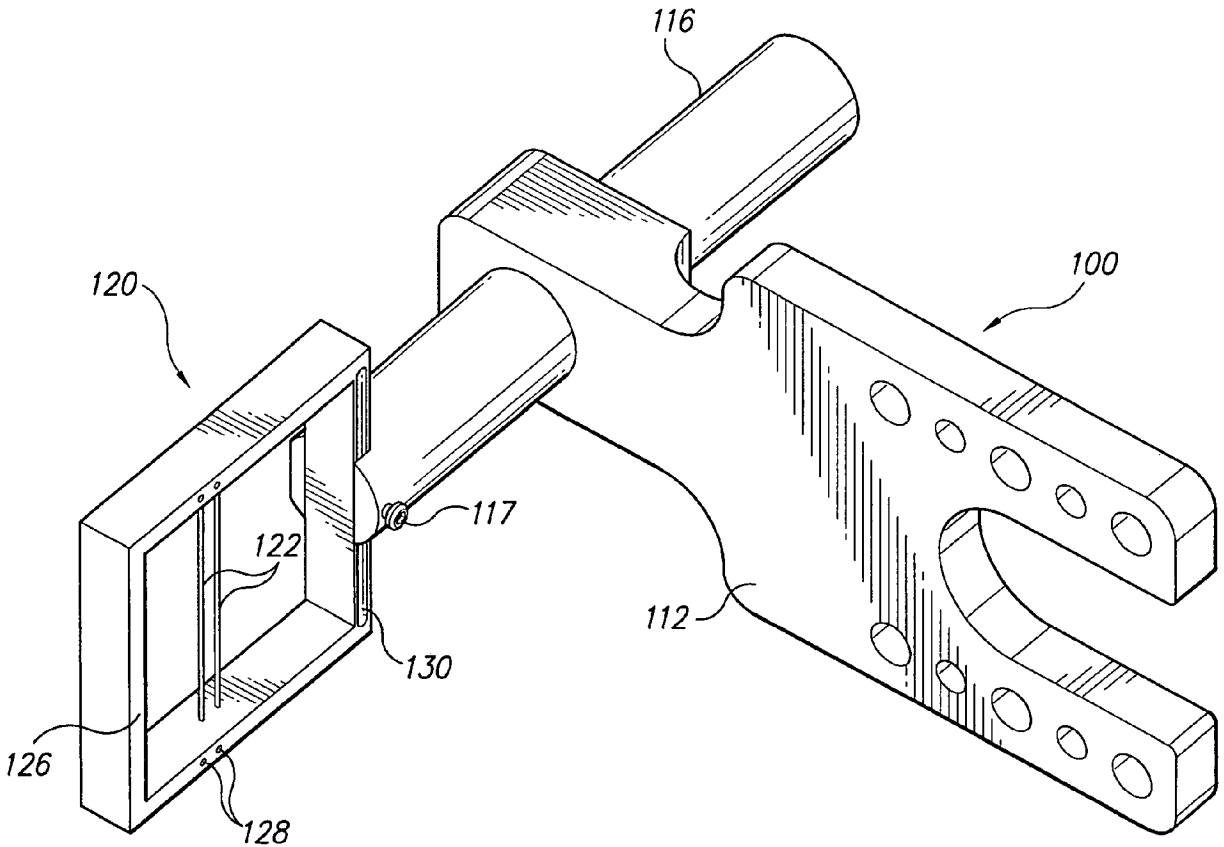
FIG. 7 is a perspective view of an alternative compound bow accessory according to the present invention.
Figure 8:
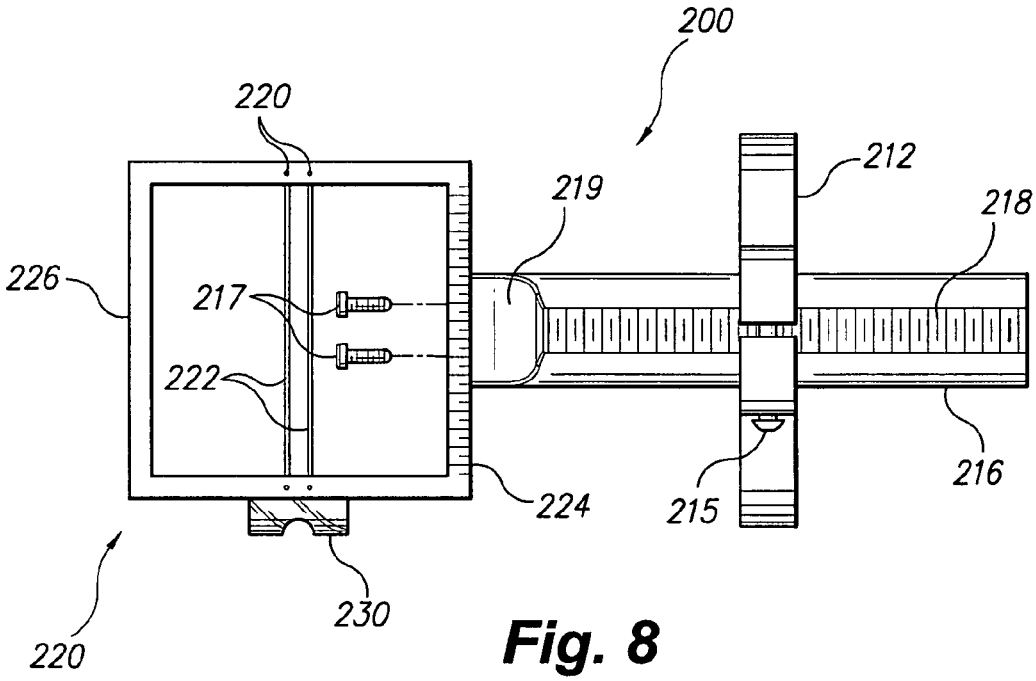
FIG. 8 is a front view of another alternative compound bow accessory according to the present invention.
Figure 9:
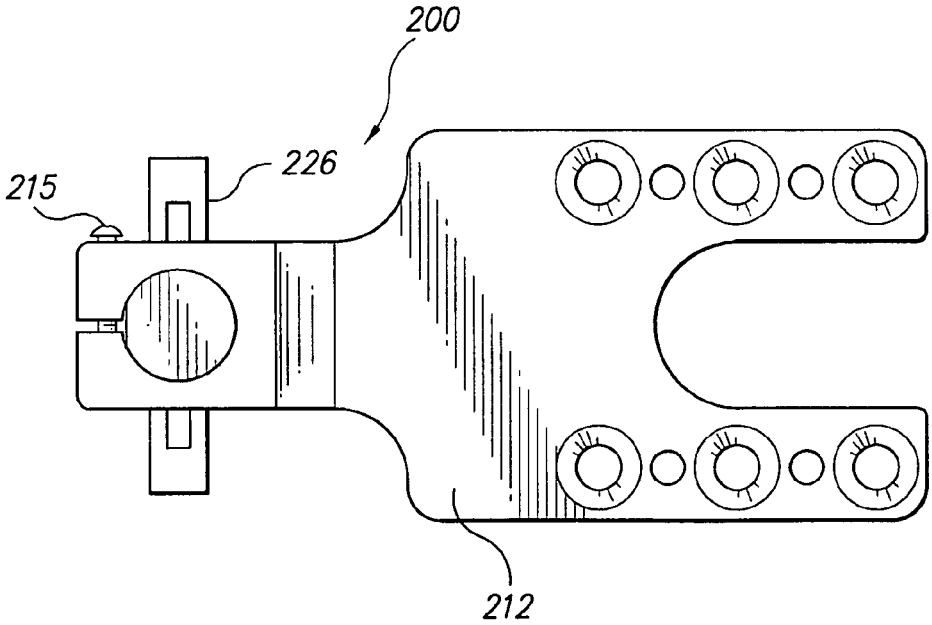
FIG. 9 is a side of the alternative compound bow accessory as shown in FIG. 8 according to the present invention.

FIG. 7 discloses an alternative compound bow accessory 100. The alternative compound bow accessory 100 includes a substantially U-shaped bracket 112 adapted for mounting onto a bow riser. The proximal end of the bracket 112 includes an extension having a substantially cylindrical through bore perpendicular to the plane of the bracket where an elongate bar 116 may be adjustably clamped. The adjustable bar 116 includes a planed flat portion that may also be provided with indicia (similar to bar 16) to accurately set the bar. The clamping screw is not shown in this view, but it is located at the end of the extension. A notch is formed on one end of the bar 116 to adjustably hold an alignment assembly 120. The alignment assembly 120 includes a substantially square-shaped housing or frame 126 having a pair of vertical alignment pins 122 disposed centrally within the frame to thereby define a gap or viewing window 123 between the alignment pins 122.

One of the side legs of the frame 126 includes a groove 130 to which a fastener 117 may project into to adjustably clamp the frame 120 relative to the bar. Although not shown in this view, the opposite side of clamping leg may also be provided with indicia (similar to indicia 24) for more accurate adjustment. Both the top and bottom legs of the frame 126 are provided with a pair of luminescent indicators 128 to help focus the user's view onto the alignment pins 122. Thus, in this embodiment, the vertical adjustment of the alignment assembly 120 is facilitated by a clamping fastener 117 riding in the groove 130. This adjustment system is a more secure way of setting the alignment assembly 120 since the fastener 117 riding in the groove 130 would prevent the assembly 120 from falling out of engagement with bar 116.

FIGS. 8 through 10B disclose another alternative compound bow accessory 200. The alternative compound bow accessory 200 includes a substantially U-shaped bracket 212, an adjustable bar 216 and an adjustably mounted alignment assembly 220. The proximal end of the bracket 212 includes an extension split at the end to form a split clamp. The extension has a substantially cylindrical through bore perpendicular to the plane of the bracket where the bar 216 may be adjustably clamped by fastener 215. The adjustable bar 216 includes a planed flat portion that may be provided with indicia 218.

Figure 10A:
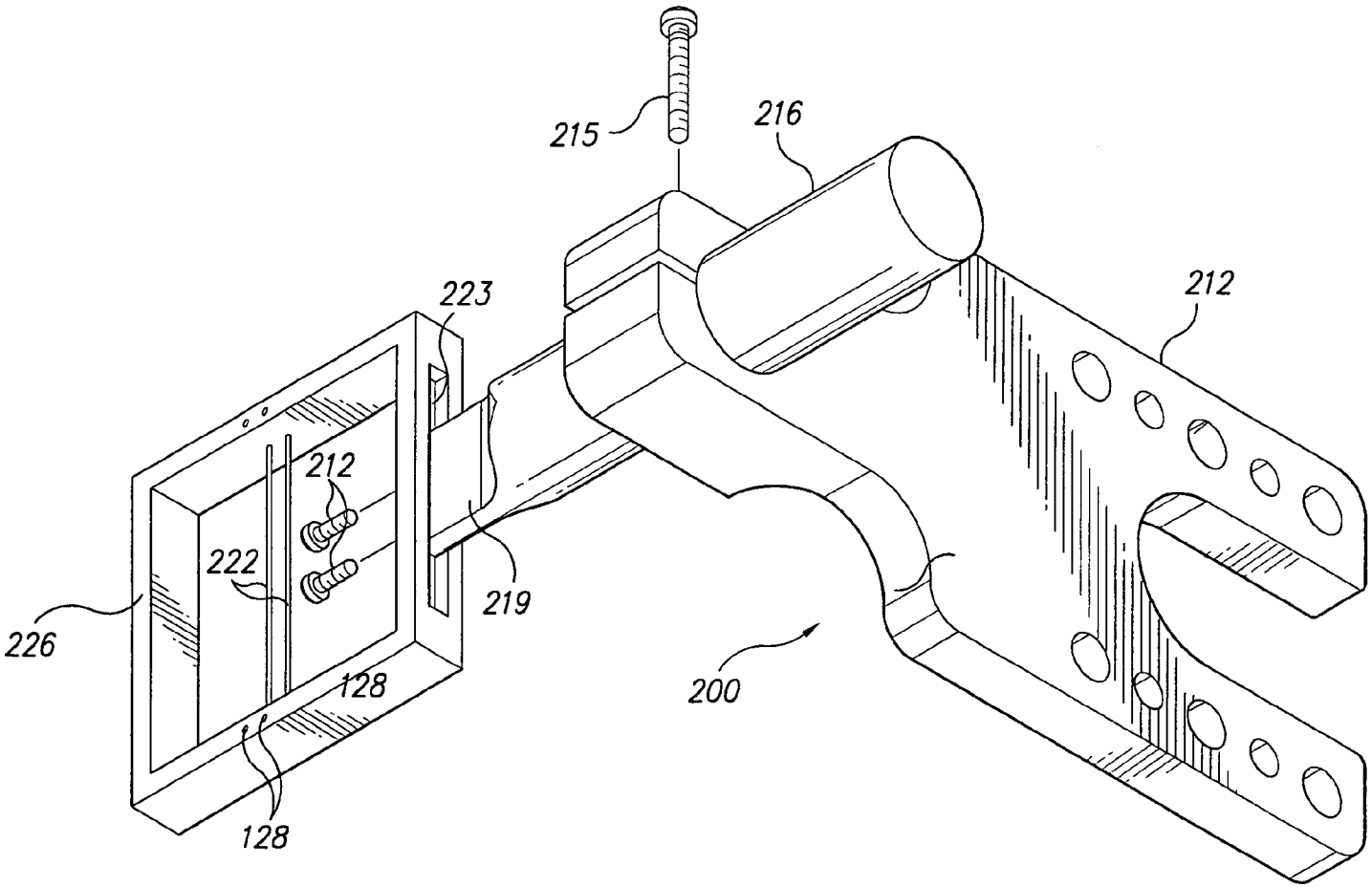
FIG. 10A is a perspective view of the alternative compound bow accessory shown in FIG. 8 according to the present invention.
Figure 10B:
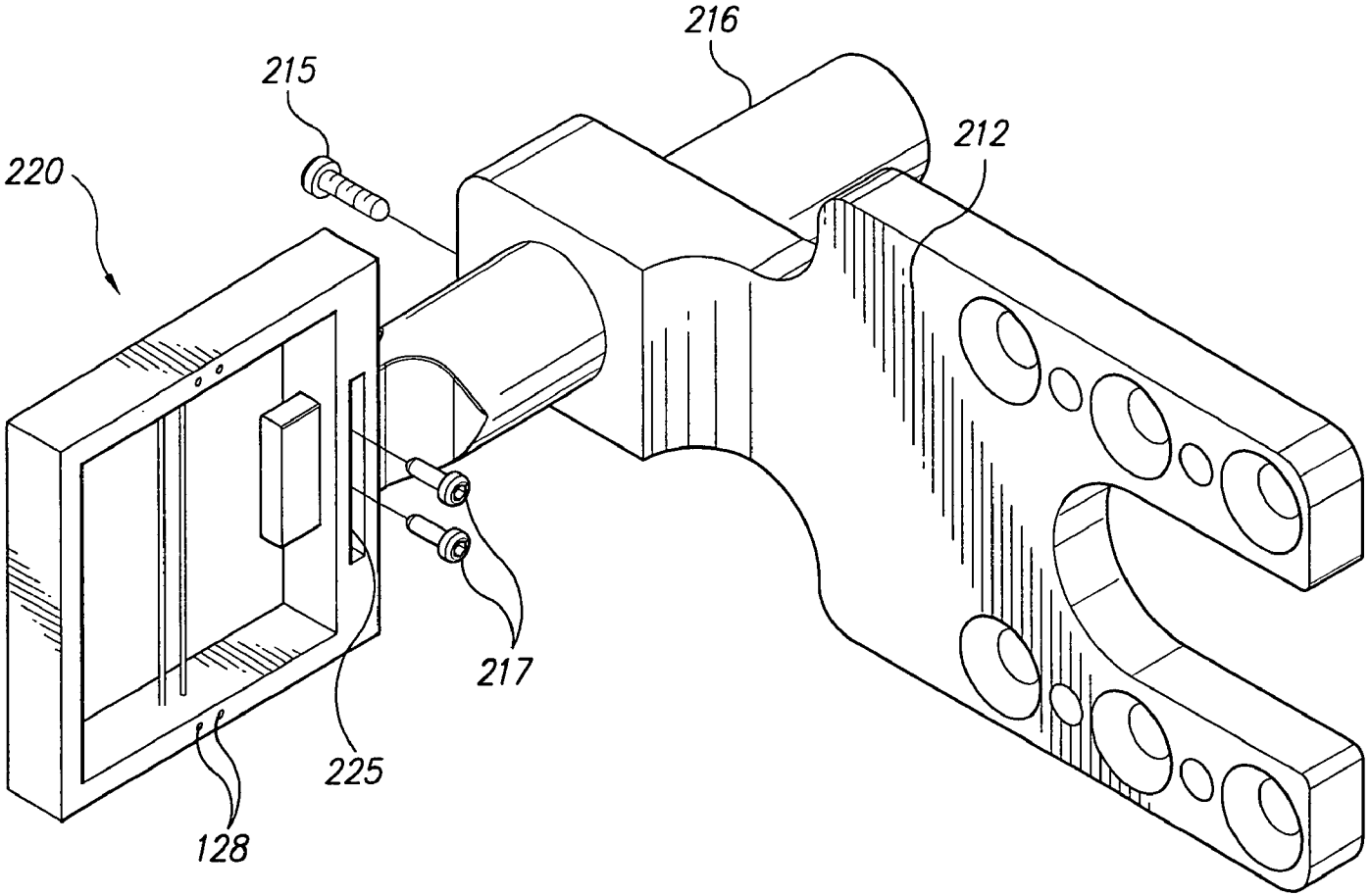
FIG. 10B is a perspective view of an alternative pin housing adjustment assembly of the alternative compound bow accessory shown in FIG. 8 according to the present invention.

In this embodiment, the end of the bar 216 that connects to the alignment assembly 220 has been reduced to form a tongue 219 adapted to slidably fit in slot 223 formed on the square-shaped frame 226. Fasteners 217 affix the alignment assembly 220 to the bar 216 once the alignment assembly has been properly adjusted, the end of the tongue including bores (not shown) for the fasteners. The alignment assembly includes a pair of vertical alignment pins 222 disposed centrally within the frame, luminescent indicators 228 to help focus the user's view onto the alignment pins 222, indicia 224 and an optional bubble level 230 for proper positioning of the bow. Thus, in this embodiment, the vertical adjustment of the alignment assembly 220 is facilitated by a tongue and groove system. Alternatively as shown in FIG. 10B, a fastening slot 225 may be provided on the outside face of the alignment assembly 220 for the fasteners 217 to adjustably affix the assembly 220 onto the bar 216.

Figure 11:
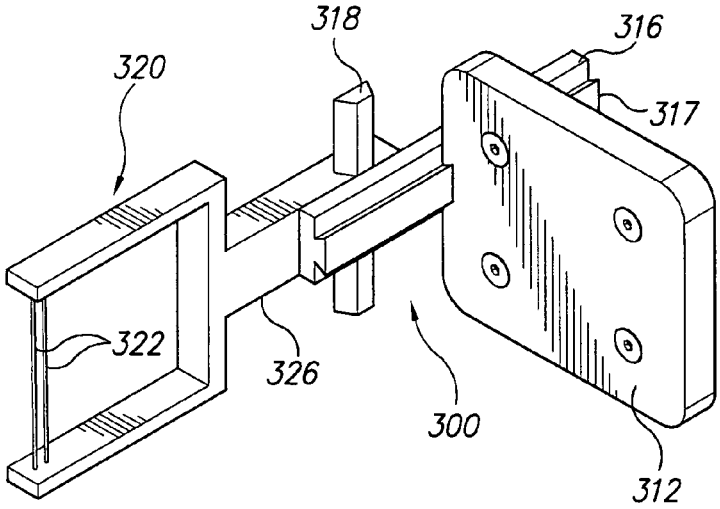
FIG. 11 is a perspective view of a further alternative compound bow accessory according to the present invention.
Figure 12:
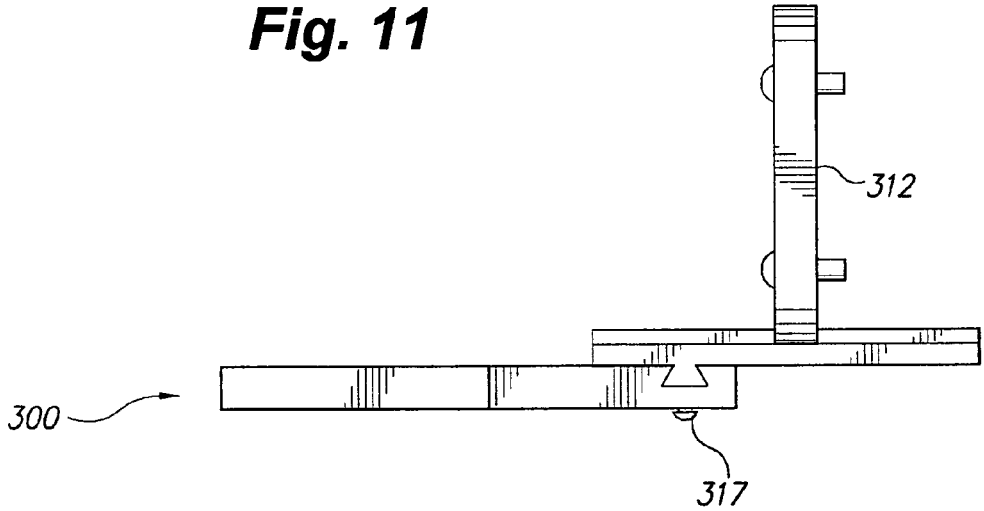
FIG. 12 is a top view of the alternative compound bow accessory shown in FIG. 11 according to the present invention.
Figure 13:
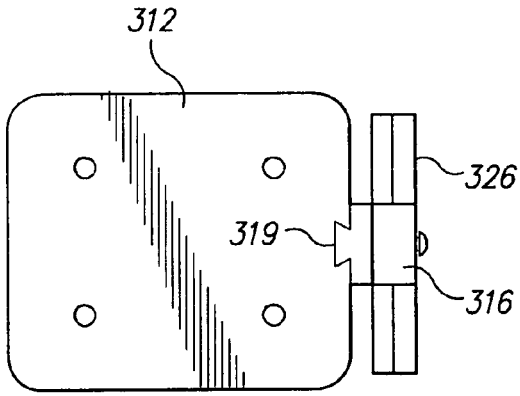
FIG. 13 is a side view of the alternative compound bow accessory shown in FIG. 11 according to the present invention.

FIGS. 11-13 discloses a further alternative compound bow accessory 300. The compound bow accessory 300 includes a substantially rectangular bracket 312 adapted for mounting onto a bow riser. One end of the bracket 312 includes a dovetail groove to adjustably mount the lateral adjustment bar 316. The lateral adjustment bar 316 is elongate, substantially rectangular in shape having a longitudinally extending dovetail 317 on one side that rides in the dovetail groove of the bracket 312. The other side of the bar 316 includes a vertically extending dovetail 318 adapted to ride in the dovetail groove of the alignment assembly 320. The alignment assembly 320 includes a substantially forked housing 326 with a pair of vertical alignment pins 322 disposed between the prongs of the housing 326. A fastener 317 clamps the alignment assembly 320 in place. Thus, in this embodiment, the vertical adjustment of the alignment assembly 320 and the lateral adjustment of the bar 316 are facilitated by a system of dovetails and dovetail grooves.

It is noted that the compound bow accessory may encompass a variety of alternatives to the various features thereof. For example, the compound bow accessory may be made from metal, plastic, wood or sturdy synthetic materials. If metal, e.g. aluminum, then it may be anodized to increase the durability and life of the accessory as well as for aesthetic appeal. The alignment pins may be formed from metal wire or any other durable and weather resistant material, and the gap therebetween may be adjustable or varied depending on the user's preference. The compound bow accessory may also be sized to be proportional to the size of the bow on which it will be employed. Moreover, the shape of the frame of the alignment assembly may be varied, e.g. circular, triangular, or trapezoidal shaped frames.

It is to be understood that the present invention is not limited to the embodiments described above, but encompasses any and all embodiments within the scope of the following claims.

I claim:

1. A compound bow accessory adapted to be used with a plurality of horizontally aligned sight pins from a bow sight, comprising:

a bracket adapted for mounting onto a bow riser;

an adjustable bar disposed perpendicular to the bracket and lying in a plane; and an alignment assembly adjustably mounted to the adjustable bar and being substantially coplanar therewith, the alignment assembly having a frame, wherein the frame has at least an upper and lower portion, and at least a pair of spaced, parallel alignment pins vertically disposed within the frame and extending from and attached to the upper to the lower frame portions, the parallel alignment pins defining a horizontal gap therebetween;

wherein aiming through the gap provides visual cues of existing hand torque when vertical alignment of the horizontally disposed sight pins from a bow sight has deviated from within the gap to thereby allow the user to correct his aim and increase accuracy of bow shots.

2. The compound bow accessory according to claim 1, wherein said bracket has a plurality of mounting holes defined therein.

3. The compound bow accessory according to claim 2, wherein said bracket is substantially U-shaped, having an extension at a proximal end for clamping engagement with said adjustable bar.

4. The compound bow accessory according to claim 3, wherein said plurality of mounting holes are disposed on the legs of said U-shaped bracket, the plurality of mounting holes including:

a plurality of counter-sunk holes adapted for mounting to a bracket of the bow sight; and a plurality of threaded mounting holes alternately disposed between the counter-sunk holes for mounting a quiver.

5. The compound bow accessory according to claim 3, wherein said extension comprises a bore perpendicular to a major plane of said bracket, the bore accommodating said bar for adjustable mounting therein, said extension having a fastener to clamp said bar in position.

6. The compound bow accessory according to claim 5, wherein said extension is split at a distal end to form a clamp around said bar.

7. The compound bow accessory according to claim 2, wherein said bracket is substantially rectangular in shape and has a dovetail groove at one end adapted for engaging said adjustable bar.

8. The compound bow accessory according to claim 7, wherein said alignment assembly comprises a substantially fork-shaped frame having prongs extending toward one side and a bar engaging portion extending toward the opposite side, said alignment pins being disposed between said prongs and the bar engaging portion having a dovetail groove adapted to engage said adjustable bar.

9. The compound bow accessory according to claim 8, wherein said adjustable bar comprises an elongate, substantially rectangular portion having a longitudinal extending dovetail on one side engageable with the dovetail of said bracket and a vertically disposed dovetail on the other side engageable with the dovetail groove of said alignment assembly;

wherein said alignment assembly is vertically and adjustably mounted to said bar and said bar is laterally adjustably mounted to the bracket via respective dovetails, dovetail grooves and fasteners.

10. The compound bow accessory according to claim 1, wherein the alignment assembly comprises a substantially square frame having a side adjustably engaging said adjustable bar.

11. The compound bow accessory according to claim 10, wherein said adjustable bar has a notch at one end for clamping engagement with the bar engagement side of said frame, the accessory further comprising a fastener clamping said frame to said adjustable bar.

12. The compound bow accessory according to claim 11, wherein said frame has a groove formed on an outside face of the bar engagement side, said fastener selectively engaging the groove to adjustably clamp the frame to the adjustable bar.

13. The compound bow accessory according to claim 10, wherein said adjustable bar has a reduced end forming a tongue for clamping engagement with the bar engagement side of said frame, the accessory further comprising at least one fastener clamping said frame to said adjustable bar.

14. The compound bow accessory according to claim 13, wherein said frame has a slot formed on the bar engagement side, the slot slidably engaging said tongue, said at least one fastener selectively engaging the slot to adjustably clamp said frame to the adjustable bar.

15. The compound bow accessory according to claim 13, wherein said frame has a clamping slot formed on an outside face of the bar engagement side, said at least one fastener selectively engaging the clamping slot to adjustably clamp said frame to the adjustable bar.

16. The compound bow accessory according to claim 1, wherein said alignment assembly includes luminescent indicators corresponding to top and bottom ends of said alignment pins.

17. The compound bow accessory according to claim 16, wherein said luminescent indicators are selected from the group consisting of optical fibers, fluorescent paint and LEDs.

18. The compound bow accessory according to claim 1, wherein said alignment assembly includes indicia on a side thereof for accurate adjustment of the assembly.

19. The compound bow accessory according to claim 1, wherein said adjustable bar includes indicia on a side thereof for accurate adjustment of the bar.

* * * * *